United States Patent [19]

Zeigler et al.

[11] Patent Number: 4,667,353

[45] Date of Patent: May 26, 1987

[54] AUTOMATICALLY CLOSING MODESTY CURTAIN

[75] Inventors: Warren L. Zeigler, Midland; Roy F. Zeigler, Freeland, both of Mich.

[73] Assignee: Tri City Laboratory Specialists, Inc., Midland, Mich.

[21] Appl. No.: 663,156

[22] Filed: Oct. 22, 1984

Related U.S. Application Data

[62] Division of Ser. No. 448,417, Dec. 9, 1982, Pat. No. 4,594,742.

[51] Int. Cl.[4] ..... A47K 3/22

[52] U.S. Cl. ..... 4/607; 4/608; 4/610; 160/84 H; 160/84 V; 160/117; 160/118

[58] Field of Search ..... 4/607, 596, 608, 609; 160/123, 126, 190, 191, 192, 340, 341, 344, 346; 52/63; 235/130 R, 51

[56] References Cited

U.S. PATENT DOCUMENTS

| | | | |
|---|---|---|---|
| 1,416,270 | 5/1922 | Deming | 4/596 |
| 1,917,127 | 7/1933 | Johnson | 160/190 |
| 1,990,470 | 2/1935 | Clark | 160/191 |
| 2,023,664 | 12/1935 | Clark et al. | 160/191 |
| 2,042,158 | 5/1936 | McKinney | 160/191 |
| 2,043,981 | 6/1936 | Bickel | 160/126 |
| 2,068,853 | 1/1937 | Foehrenbach et al. | 52/63 |
| 2,166,746 | 7/1939 | Bartel | 160/191 |
| 2,284,144 | 5/1942 | Gustavson | 52/63 |
| 2,347,824 | 5/1944 | Gustavson | 52/63 |
| 2,495,672 | 1/1950 | Dautrick | 160/191 |
| 2,514,370 | 7/1950 | Bunnell | 160/190 |
| 3,206,187 | 9/1965 | Cagley | 160/123 |
| 3,815,656 | 6/1974 | Kober et al. | 160/123 |
| 4,120,341 | 10/1978 | Doering | 160/190 |
| 4,167,205 | 9/1979 | Gerdeman | 160/123 X |

*Primary Examiner*—Henry K. Artis

*Attorney, Agent, or Firm*—Robert L. McKellar

[57] ABSTRACT

What is disclosed in an automatically closing modesty curtain which allows the user assured complete privacy and which does not require continued manipulation by the hands thereby leaving the hands free to undertake other tasks. For example, in an emergency shower situation, once the handle on the safety shower is pulled, the user can be assured of complete privacy while removing contaminated clothing while being simultaneously deluged by shower water.

2 Claims, 6 Drawing Figures

AUTOMATICALLY CLOSING MODESTY CURTAIN

This application is a division, of application Ser. No. 448,417, filed 12/9/82 now U.S. Pat. No. 4,594,742.

BACKGROUND OF THE INVENTION

This invention relates to an automatic closing modesty curtain and its use in safety showers and the like.

The key to the invention is that once the curtain has been triggered to close, there are no additional manipulations required by the user because the curtain will completely close by itself. This leaves the operator's hands free to perform other tasks using both hands, such as removing chemically contaminated clothing as rapidly as possible.

In the prior art, there are two patents that relate to the subject matter. Gustavson, U.S. Pat. No. 2,284,144, issued on May 26, 1942 and Shoup, U.S. Pat. No. 2,826,365, issued Mar. 11, 1958. Both deal with voting machines wherein the movement of the manually operated handle closes the curtain about the user prior to actuating the vote counting mechanism of the machine. When the vote counting operation has been finished, the voter moves the handle manually in the opposite direction from that first used when the voter entered the voting booth and this movement opens the curtain and allows the voter to step out of the booth. It should be noted, and emphasized, that the entire operation is manual and requires continuous, positive force by the user to both open and close the curtains.

The Invention

From the disclosure above it is quite apparent that there is a need for a curtain closing system that is automatic, that is, a system whereby the user is not required the use continuous positive force to completely close and open a curtain.

It is therefore an object of this invention to provide an automatically closing modesty curtain which allows the user assured complete privacy.

It is another object of this invention to provide a curtain system which can be used for safety showers and the like which allows complete privacy and which does not require continued manipulation of the curtains by the hands to close, thereby leaving the hands free to undertake other tasks.

Other and further objects and advantages of the invention will be more fully understood from a consideration of the following specification taken in conjunction with the accompanying drawings; and in which FIG. 1 is an isometric view of the curtain system using a counter weight method of moving the curtains. It is shown in conjunction with a typical safety shower which uses a water deluge.

Figure 1:
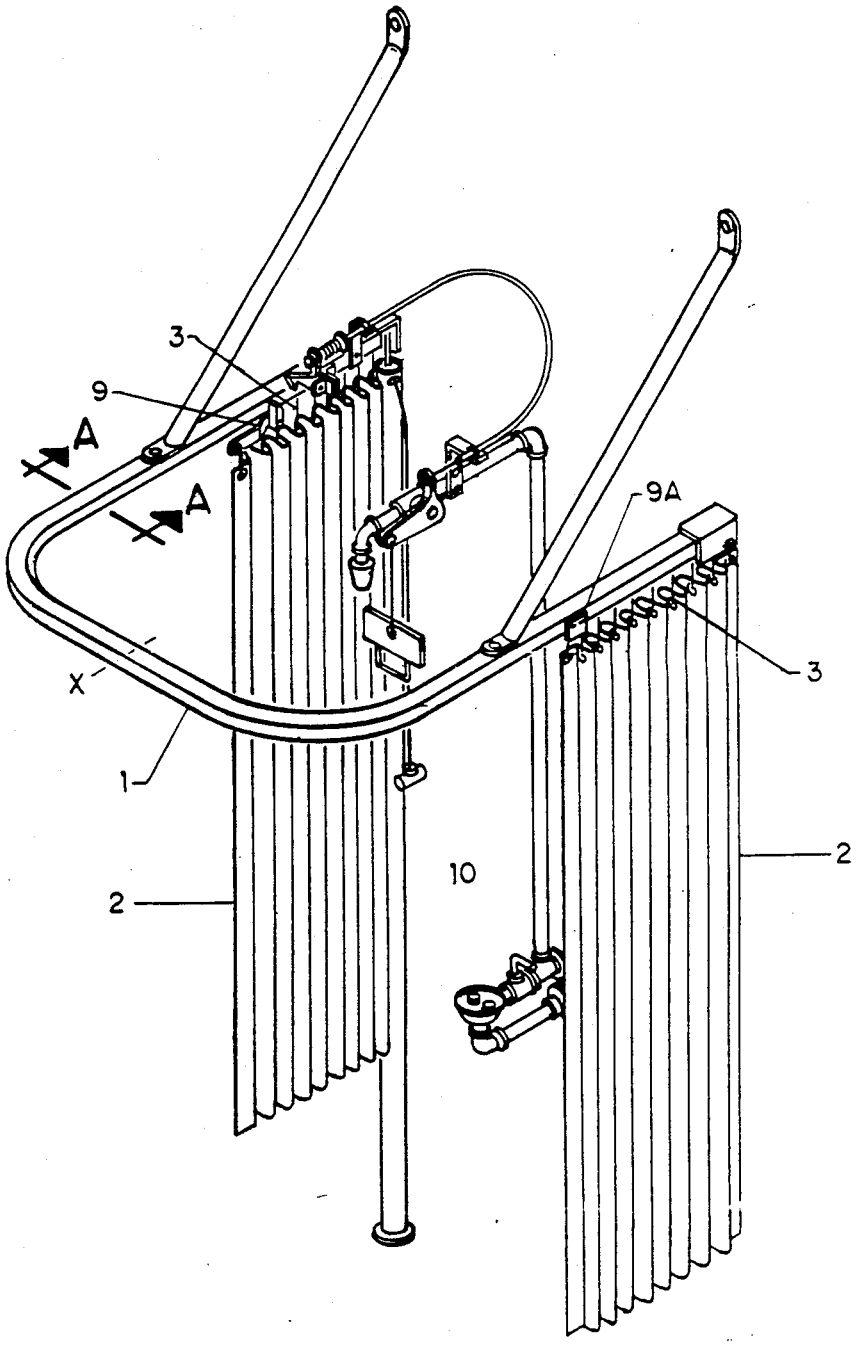

Reference is now made to the drawings wherein in FIG. 1 the numeral 10 denotes a general isometric view of an automatic modesty curtain system on a safety shower in which one modification of the invention is shown. The curtain system as shown in FIG. 1 comprises a curtain support 1 which is shown as a u-shaped member which has been firmly attached to a wall member at the tips of the u-shape. There is suspended from this curtain support member 1, a pair of curtains 2 which are shown in FIG. 1 as bi-parting. For purposes of this invention, the curtain can also be a single curtain which is drawn from one end of the u-shaped supporting member 1 to the other tip of said u-shaped member. Also, for purposes of this invention, it is contemplated within the scope of this invention that the support member 1 can also be circular in shape and be essentially free-standing with its own support system rather than being attached to a wall for support.

Figure 2:
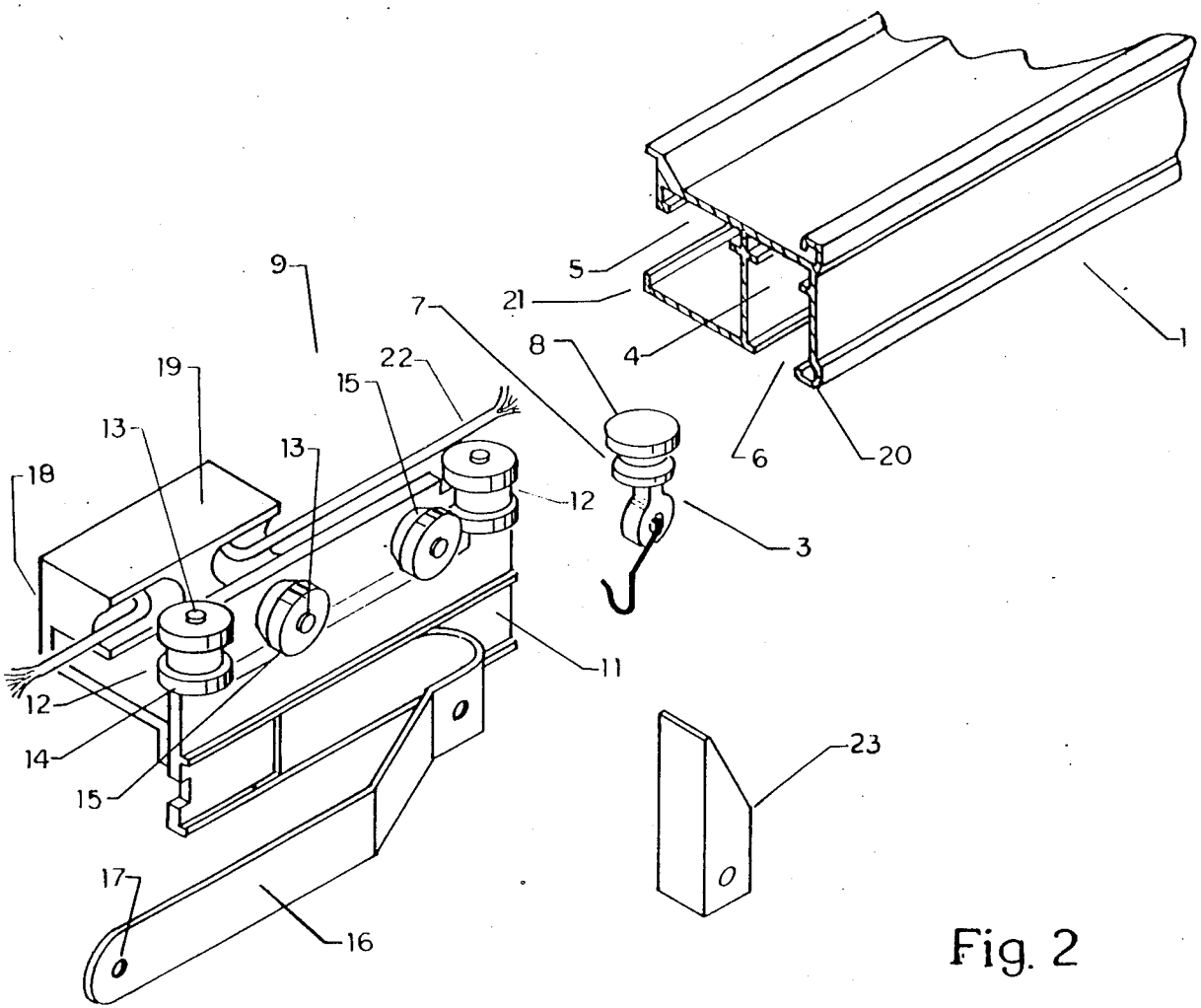
FIG. 2 is an enlarged isometric view of a portion of the curtain support, dual track, roller assembly and slide-hangers used for moving the curtain.

The curtains are suspended from the support member by a series of curtain slide-hangers 3 which are attached to and spaced along the top edge of the curtain at various intervals such that the curtain is sufficiently supported and the curtain gathers in a uniform fashion when it is open and the curtain is uniformly distributed along the support member 1 when the curtain is closed. The slide-hangers 3 are slidably attached on their upper ends to the support member 1 as shown in detail in FIG. 2. Referring to FIG. 2, there is shown a cross-sectional view along the lines of A—A of FIG. 1, of the curtain support member 1. The curtain support member 1 consists of dual tubes; a slide-hanger tube 4 and a cord tube 5. The slide-hanger tube 4 is constructed such that it is essentially tubular but does not completely close on its bottom edge, which non-closure forms an opening which opening is essentially a slot 6 which runs the entire length, on the bottom edge of tube 4. The width of the slot 6 is dependent on the size of the neck 7 and the head 8 of the slide-hanger 3. The head 8 of the slide-hanger 3 should be larger than the width of the slot 6 but smaller than the width of the tube 4, this proximity in sizes allows the slide-hanger 3 to be supported in the tube 4 yet be freely movable along the slot 6 and carry the curtain 2 when force is applied to the slide-hangers 3. Also with reference to FIG. 2, the series of slide-hangers 3 are urged along the slot 6 by a lead roller assembly 9. The roller assembly 9 consists of a carriage 11 which is manufactured from lightweight metal or plastic which is surmounted by two wheel assemblies 12, which are permanently attached to the carriage 11 by pins or bolts 13. The wheel assemblies are attached, one on the leading top edge of the carriage and the other on the trailing top edge of the carriage. The wheels 14 are mounted horizontally and as shown in FIG. 2, a small distance apart, this distance being small enough such that the carriage, with the wheels mounted thereon does not exceed the heighth of the opening of tube 4. The wheels 14 guide the lead roller assembly 9 through the tube 4 such that the lead roller assembly 9 does not bind in the tube 4 and it remains freely horizontally movable. The single wheels 15 are permanently mounted horizontally on the carriage such that the top of the wheels 15 exceed the upper most surface of the upper wheel of the wheel assemblies 12. The wheels 15 essentially carry the lead roller assembly 9 along the lower edges of the slot 6 of the tube 4 and prevent the lead roller assembly 9 from resting on the edge of the slot 6 and binding the lead roller assembly in the tube 4. Thus, the lead roller assembly remains freely horizontally movable.

There is further permanently attached to the lower half of one of the vertical planar surfaces of the carriage by means of a pin or bolt a bracket 16. The bracket 16 is offset from the planar surface of the carriage 11 in order to allow the insertion of a bolt or hook through a slot 17, in the leading end of the bracket 16, in order to attach the leading edge of the curtain 2. When force is applied to the lead roller assembly, it moves through tube 4 upon wheels 15, guided by wheels 14 and either drags or pulls the leading edge of the curtain 2 which, in turn, either drags or pulls slide-hangers 3 which in turn either opens or closes the curtain 2.

There is mounted on the planar surface of the carriage 11, on the side opposite the bracket mounting, an L-shaped member 18 which is a cable attachment and guide. The L-shaped member 18 is permanently mounted on the planar surface with the top of the L being the attachment point and the L laying perpendicular to the planar surface of the carriage 11. The foot 19 of the L shaped member is in the up position. There is permanently mounted on the toe of the L-shaped member, a means for attachment of a cable (not shown).

When the lead roller assembly 9 is placed in the dual tubes 4 and 5, the wheels 15 ride in groove 20 which forms the edge of the slot 6 and, the foot 19 of the L-shaped member 18 slips over the rail 21 and rests on said rail for support and guidance. When the lead roller assembly 9 has a cord or cable 22 attached to the outside of the L-shaped member, the lead roller assembly is moved through the tubes 4 and 5. Obviously, the cable or cords 22 also travel in these same tubes.

Also shown in FIG. 2 is a catch 23 which is manufactured from plastic or metal and which serves to hold the lead roller assembly in place in the stand-by position. The catch is shown in an isometric view, detached from the lead roller assembly. The catch is mounted on the rear of the bracket 16 using a bolt, screw, or similar device.

Figure 3:
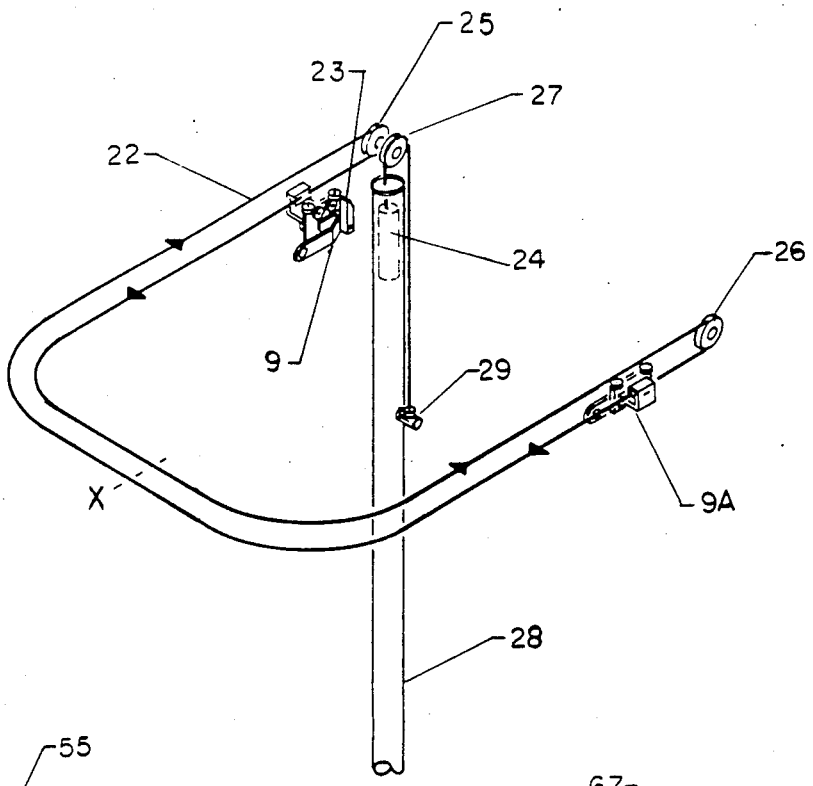
FIG. 3 is an enlarged schematic diagram of the draw cord mechanism showing the position when the curtain is open.

It should be apparent that there is only one such lead roller assembly required for this invention. Where there is used bi-parting curtains such as is shown in FIG. 1, an additional lead roller assembly 9A may be required, however, such additional lead roller assembly 9A need not have the catch 23, described above, mounted thereon. Such an additional lead roller assembly, when used, is essentially a mirror image of the lead roller assembly described above and is used on the opposite side of the U-shaped supporting member 1. The invention is constructed such that the lead roller assemblies work in unison. The means for working the lead roller assemblies in unison depends on a cable assembly, substantially shown in schematic in FIG. 3. What is shown in FIG. 3 is a cable 22 having a finite length, depending on the distance of travel required to close the curtains of this invention. This cable can be a strong cord or a metal cable and can be sheathed in plastic or some similar coating to ensure durability of the cable. The cable is fixedly attached on one end to a weight 24. The weight 24, for purposes of this invention, must be heavy enough to overcome the inertia required to move the mass constituted of the curtains 2, slide-hangers 3, lead roller assemblies 9 and 9A and enough additional weight to overcome the frictional forces of the slide-hangers 3, lead roller assemblies 9 and **9*a* and the cable of the invention. Following, then, the assembly of the cable, the end of the cable distant from the weight attachment point is allowed to pass over a first vertical pulley 25, which pulley is preferably fixedly attached to the interior surface of the support member 1 (not shown), within tube 5 and at the point where the support member 1 contracts a wall or other supporting structure. The cable 22 is then passed through tube 5, on through the full length of tube 5 to the opposite end of the support member 1 where the cable is allowed to pass over a second pulley 26 and the cable is re-inserted in the support member 1 but now the cable passes in the reverse direction and passes through tube 5, running the entire length of tube 5 until the opposite end of the tube is reached, whereupon the cable passes over a third pulley 27 and essentially hangs vertically free, finally terminating in a handle or knob 29 which allows the cable to be pulled partially through the assembly in order to place the cable system in the stand-by or locked open position. The amount of cable hanging vertically free is dependent on the length of cable required to place the system in a stand-by position, yet allow enough cable to extend from pulley 27 such that the cable is easily retrieved for setting in the stand-by position. As described for pulley 25 above, pulleys 26 and 27 are preferredly fixedly attached to the interior surface of the support member 1 (not shown) within tube 5 at the point where the support member 1 contacts a wall or other supporting structure. It is within the scope of this invention to add or shorten cable and to add or take away pulleys in order to accomodate the various lengths of curtains required in this invention. Lead roller assemblies are then attached to the cable in the proper positions. For purposes of illustration and referring yet to FIG. 3, wherein the cable is shown in one of the stand-by positions, the lead roller assembly 9, having mounted thereon the catch 23, is positioned on cable 22 at a point in front of pulley 27 such that there is adequate room for a curtain positioned thereon to uniformly hang. This distance is not critical as long as the distance is such that the slide-hangers and lead roller assembly are not crowded so closely together that they become fouled and they are not spaced too far from the pulley 27 such that the curtain is substantially closed thereby disallowing easy access to the user. In a similar manner, the lead roller assembly 9A, without the catch 23 mounted therein, is positioned and fastened on to the cable 22 at a point just behind pulley 26, that is,: roller assembly 9A is attached to the cable as it exits the pulley 26. Thus, when the curtain is released from the stand-by position, weight 24 drops down cylindrical encasement 28, drawing cord 22 after it, causing lead roller assemblies 9 and 9A to move simultaneously along the support member 1, carrying curtains 2 to an approximate mid-point X After use, when resetting the curtains, handle 29 is grasped and pulled, causing cable 22 to reverse direction, causing lead roller assemblys 9 and 9A** to reverse direction, thus opening the curtains and returning the weight to the stand-by position.

Figure 4:
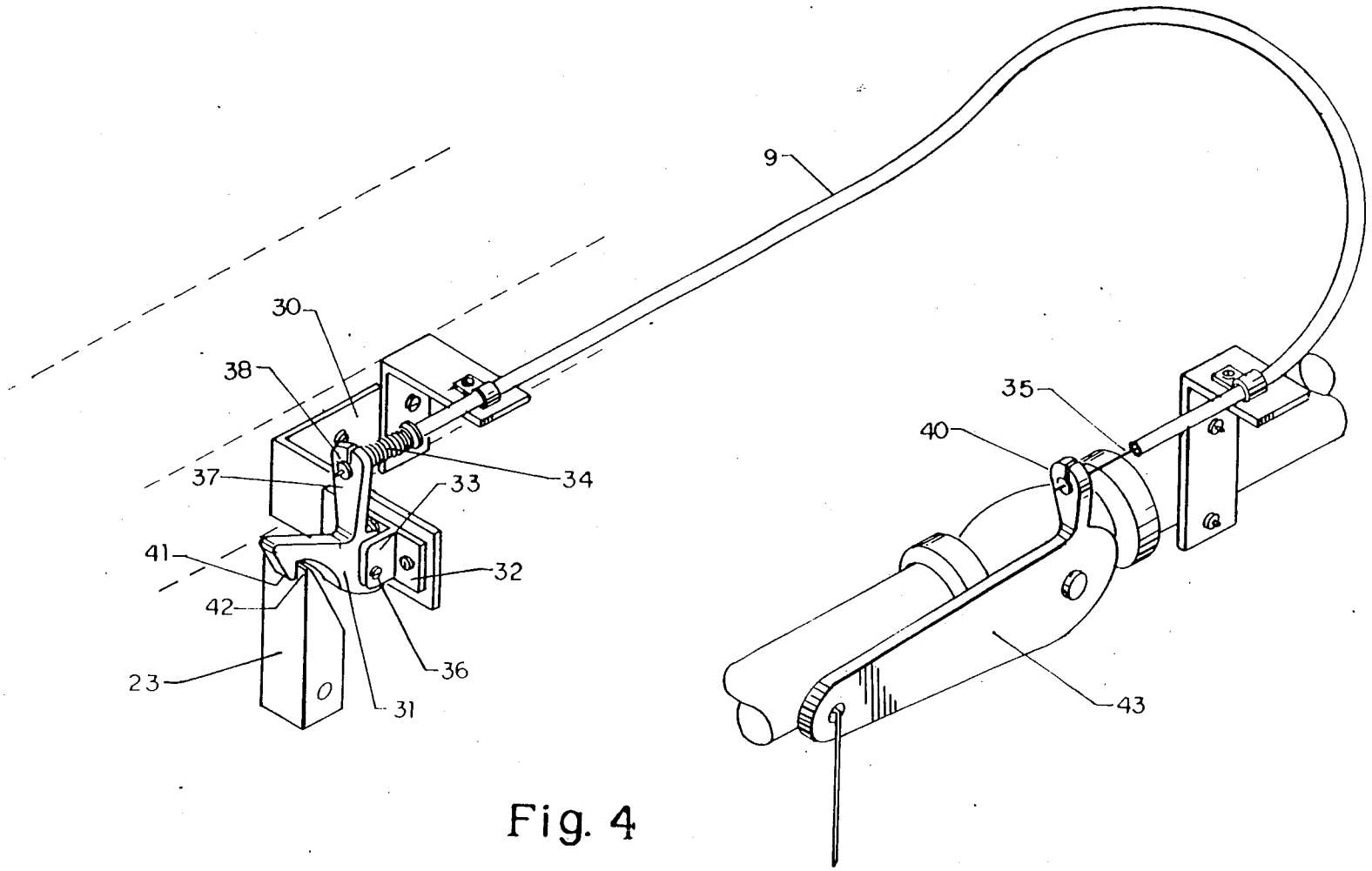
FIG. 4 is an isometric view of the trigger mechanism showing its connection to the curtain lead roller assembly and its further connection to the shower valve handle.

In the stand-by position, it is imperative that the system be locked into position so that the curtains do not close and prevent easy entry to the curtained enclosure. One such method of locking can be viewed in FIG. 4 where, for illustration purposes, a locking mechanism is shown in conjunction with a shower valve and handle as one embodiment. Shown in phantom is a section of the support member 1 which has fixedly attached thereto a standard L-bracket 30. This L-bracket is mounted on the inside exterior surface of the support member 1. Fixedly mounted on the forward planar surface of the L-bracket is a rocker arm latch mechanism 31 consisting of an essentially flat plate 32, having mounted therein, perpendicular to the flat plate surface, a pair of fulcrum mounts 33, spaced far enough apart to allow insertion of the rocker arm latch mechanism 31. The rocker arm latch mechanism 31 is attached to the fulcrum mounts 33 at the fulcrum point of the rocker arm latch mechanism 31 by a pin 36, such that the rocker arm latch mechanism rocks freely on the pin 36. At the upper end of the rocker arm latch mechanism 31 and continous therewith is a depresser arm 37 through which there is provided a slot 38 to accommodate one end of a control cable 35. This end of the control cable 35 is solidly fixed in the slot 38 and moves with any motion of the depressor arm 37. Immediately behind the depressor arm 37 there is circumferentially mounted through the long opening of the spring, a latch return spring 34 which spring slides over the control cable 35 and when in place, one end of the spring impinges on the back surface of the depressor arm 37. The other end of the spring 34 impinges on a sheath or collar 39 which surrounds the control cable 35. The length of the control cable 35 is not critical and depends on how one desires to attach said control cable and whether it is desired to make the control cable co-activatable with a valve or handle which activates a further mechanism such as a shower valve. The opposite end of the control cable 35 is firmly attached to a handle or trigger such as that shown at 40. When the rocker arm latch mechanism is moved into the stand-by or locked position as shown in FIG. 4, a latch mechanism tip 41 is urged slightly upward by the catch 23 (which is mounted on the lead roller assembly 9, not shown, discussed above) and when an upper-most tip 42 of the catch 23 passes by the latch mechanism tip 41, the catch 23 is captured and held in a locked position.

Thus, when lever 43 is activated by pulling, control cable 35 is drawn towards the lever 43, compressing latch return spring 34 and at the same time pulling depressor arm 37 towards the flat plate 32, which causes a rocker action on latch mechanism tip 41, lifting said tip to release catch 23 which, as described above, is attached to lead roller assembly 9. Releasing lead roller assembly 9 closes the curtains as is also described above.

Thus, when in combination, and with reference to the various figures, when the lever 43 is pulled, control cable 35 is activated and moves in a direction which compresses latch return spring 34 which pulls depressor arm 37 towards the flat plate 32 which causes latch tip 41 to move upward and release catch 23. Once latch 23 is released, weight 24 drops by gravity through cylinder 28, moving the cable attached thereto in the same direction, thereby moving both lead roller assemblies 9 and 9a in a forward direction, which causes curtains 2 attached thereto to side by means of slide-hangers 3, along the support member 1 through slot 6 until the lead roller assemblies 9 and 9A come together at about a medium point on the support member 1, thereby causing the curtains to form a curtained enclosure. After use, handle 29 is pulled causing the cable 22, attached thereto, to reverse direction from that taken by activation of lever 43, thereby causing cable 22 to move lead roller assemblies 9 and 9A to their starting positions (illustrated in FIG. 3) whereupon catch 23 mounted on lead roller assembly, 9 gently urges latch mechanism tip 41 in an upwardly direction, allowing catch 23 to slip past said tip and allowing said tip to drop back into position after the catch 23 passes, owing to the positive force on depressor arm 37 provided by spring 34, and further whereupon catch 23 is held firmly against tip 41 owing to the force applied by the catch 23 against the tip 41, which force is derived from tension on lead roller 9 provided by cable 22 which is weighted at one end by weight 24.

Figure 5:
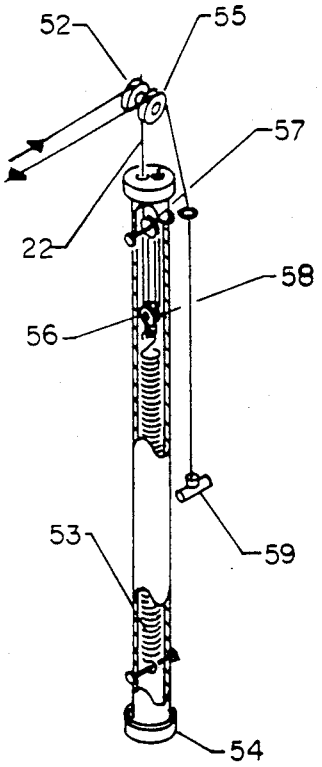
FIG. 5 is a view of a tension spring means as an alternative mode of moving the curtains.

It is contemplated within the scope of this invention that the non-electrical drive means can be modified to accomodate a particular design of a curtain system. For example, the weight-drop drive mechanism illustrated in FIG. 3 is satisfactory for a small curtain enclosure such as a safety shower or a voting booth but it may be entirely impractical for a larger enclosure, such as that desired around a hospital bed or in a hospital emergency treatment room or physical therapy room. Thus, FIG. 5 illustrates a modification of a non-electrical drive means useful in this invention. Referring now to FIG. 5, there is shown a view of an alternate drive mechanism of this invention wherein pulley 52 is essentially the same as and operates essentially the same as pulley 25 of FIG. 3. It should be noted that cable 22 is drawn over the top of the vertical pulley 52 and enters a housing 54. Cable 22 is then drawn up under a pulley 56 which pulley is fixedly attached to a tension spring 53, which spring is shown in its' fully stretched position with a further fixed attachment of the spring 53 to the bottom of the enclosure 54. From pulley 56, the cable 22 is brought up and over pulley 57, which pulley is fixedly attached to the upper part of enclosure 54. The cable 22 then travels down to and is brought up and under a final pulley 58 and then the cable 22 is permanently attached to a position on the interior surface of the enclosure 54. Pulley 58 is essentially adjacent to and parallel with pulley 56 and both pulleys 56 and 58 move commensurately in the same direction and with the same relative rate. The opposite end of the cable 22 travels as essentially illustrated in FIG. 3, wherein cable 22 is drawn over pulley 55 finally culminating in handle 59. When the handle 43 in FIG. 4 is pulled, releasing the catch 23, the spring 53 retracts to its' resting position, thereby moving cable 22 and pulling pulleys 56 and 58 to the lower end of enclosure 54 which in turn moves lead roller assemblies 9 and 9A, which in turn closes curtains 2. In order to reset the system, handle 59 is pulled, moving cable 22 in a direction reverse of that during curtain closing, whereby the curtains are parted, tension is set in spring 53 and the lead roller assembly 9 is locked into position.

Figure 6:
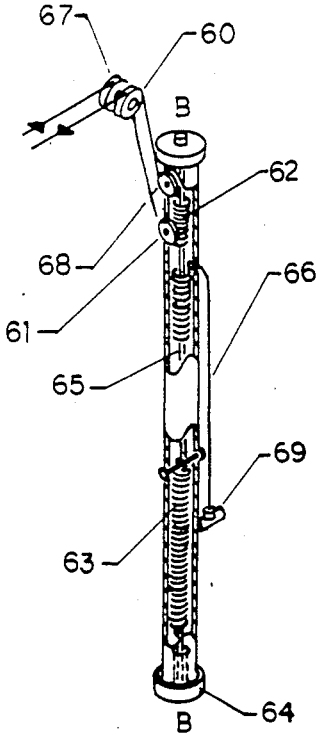
FIG. 6 is a view of a torsion spring means as an alternative mode of moving the curtains.

A further alternative for driving the mechanism of this invention is shown in FIG. 6 wherein there is shown a torsion spring drive means. In this drive means, there is shown an enclosure 64 which contains a winding roller 65, which roller is rotatably supported within the enclosure 64 and points B,B. Wrapped around the roller bar 65 is a torsion spring 63 (shown on the lower half of the roller bar for illustration purposes only) which has one end fixedly attached to the roller bar while the opposite end of the spring 63 is fixedly attached to the interior surface of the enclosure 64. Also wrapped around the roller bar 65 is a cable 66 which has one end securely fastened to the roller bar and the opposite end extended through an opening in the enclosure 64, which cable culminates in a handle 69. The number of wraps of cable 66 around the roller bar 65 is dependent on the number of rolls of the bar required to put adequate tension in the torsion spring 63. Adequate tension means that enough tension is applied to the spring 63 to completely close the curtains of this invention when the force on the torsion spring is released. Also wrapped around the roller bar 65 is cable 62 which is essentially the same as the drive cable 22 as illustrated in FIG. 3. The difference between cable 22 and cable 62 is that cable 62 is a continuous cable. Cable 62 is wrapped around roller bar 65 an appropriate number of times. An appropriate number of times means that there must be enough wraps around the roller bar 65 to allow the complete closing of the curtains 2 when the catch 23 is released and the curtains are allowed to close. Conversely, this amount of wraps of cable 62 around roller bar 65 also needs to allow the complete opening of the curtains and therefore, for all practical purposes, the number of wraps of cable 62 around roller bar 65 is predetermined to accomplish the above desired results. There are also located outside enclosure 64 (the pulleys may also be located inside the enclosure 64) a series of pulleys wherein pulley 67 is essentially the same and works essentially the same as pulley 25 of FIG. 3, wherein cable 62 travels from the led roller assembly 9 (not shown), over pulley 67 and under pulley 61 where the cable 62 passes through an opening in enclosure 64 and contacts and wraps around roller bar 65. After the appropriate number of wraps around roller bar 65, cable 62 exits enclosure 64 essentially in a reverse direction from that when it entered enclosure 64 to contact and pass up and under a pulley 68 and finally up and over a similar pulley 60 to lead roller assembly 9. When handle 69 is pulled, cable 66 causes roller bar 65 to rotate in the direction of the pull while torsion spring 63 is tightly coiled and simultaneously cable 62 is moved in a direction to cause lead roller assemblies 9 and 9*a* (not shown) to move to their set positions and maintain the curtains in an open position. Therefore, when handle 43 in FIG. 4 is activated, lead roller assembly 9 with catch 23 is released and the force provided by the tension stored in torsion spring 63 causes roller bar 65 to move in a direction opposite that when moving to the set position, thereby causing cable 62 to move in the same direction thereby causing cable 62 to wind in the opposite direction thereby causing lead roller assembly 9 to move in the opposite direction thereby causing the curtains 2 to close.

That which is claimed is:

1. An automatically closing modesty curtain including a support means for said curtain, a curtain-moving mechanism, a non-electrical drive means wherein the non-electrical drive means is comprised of a tension spring means which consists of a cable, a first set of pulleys which carrys and assists said cable in moving the curtain; a second set of pulleys which are essentially free-floating and attached to a tension spring, and which carry and assist said cable to help set and relieve tension in the tension spring, which tension spring is fixedly attached to a housing on its end opposite the attachment to the second set of pulleys and, a third pulley which is fixedly attached to the housing and which carrys and assists said cable by turning in response to the movement of said cable in the second set of pulleys, and further, at least one roller assembly attached to said cable.

2. An automatically closing modesty curtain including a support means for said curtain, a curtain-moving mechanism, a non-electrical drive means wherein the non-electrical drive means is comprised of a torsion spring, wrapped around and fixedly attached to a roller bar, a first cable which is continuous, which is carried and assisted by a first pulley, which cable after leaving the first pulley is wrapped around the roller bar and which cable is returned to and assisted by a second pulley, the whole of which moves the curtain; a second cable which is wrapped around, and fixedly attached on one end to the roller bar, in a location different than the first cable, said cable passing through an opening in a housing and culminating in a pull knob which cable, when pulled by the pull knob, rotates the roller bar which in turn moves the first cable, and any lead roller assembly attached thereto, to move in a direction which opens the curtains and at the same time tightly coils the torsion spring to store energy, whereupon, when released, the torsion spring releases its energy and causes the said roller bar to reverse direction, thereby causing the second cable to reverse direction and to wrap around the roller bar, thereby causing the first cable and any curtains attached thereto to close.

* * * * *